United States Patent [19]

Hessel et al.

[11] Patent Number: 5,073,292

[45] Date of Patent: Dec. 17, 1991

[54] HEAVY DUTY LIQUID DETERGENT COMPOSITIONS CONTAINING ENZYMES STABILIZED BY QUATERNARY NITROGEN SUBSTITUTED PROTEINS

[75] Inventors: John F. Hessel, Metuchen, N.J.; Michael P. Aronson, West Nyack, N.Y.; Martin S. Cardinali, Millington; Howard B. Kaiserman, Cliffside Park, both of N.J.

[73] Assignee: Lever Brothers Company, Division of Conopco, Inc., New York, N.Y.

[21] Appl. No.: 534,780

[22] Filed: Jun. 7, 1990

[51] Int. Cl.[5] ..... C11D 3/386; C11D 3/37

[52] U.S. Cl. ..... 252/174.12; 252/174.23; 252/DIG. 12; 252/DIG. 14

[58] Field of Search ..... 435/264; 252/174.12, 252/DIG. 12, 174.23, DIG. 14

[56] References Cited

U.S. PATENT DOCUMENTS

| | | | |
|---|---|---|---|
| 3,560,392 | 2/1971 | Eymery et al. | 252/138 |
| 3,819,528 | 6/1974 | Berry | 252/153 |
| 4,011,169 | 3/1977 | Diehl et al. | 252/95 |
| 4,142,999 | 3/1979 | Bloching et al. | 252/544 |
| 4,305,837 | 12/1981 | Kaminsky et al. | 252/174.12 |
| 4,404,115 | 9/1983 | Tai | 252/135 |
| 4,451,385 | 5/1984 | Tauss et al. | 252/132 |
| 4,462,922 | 7/1984 | Boskamp | 252/174.12 |
| 4,490,285 | 12/1984 | Kebanli | 252/551 |
| 4,537,707 | 8/1985 | Severson, Jr. | 252/545 |
| 4,652,394 | 3/1987 | Inamorato et al. | 252/174.12 |
| 4,842,758 | 6/1989 | Crutzen | 252/8.7 |
| 4,842,767 | 6/1989 | Warscheski et al. | 252/525 |

FOREIGN PATENT DOCUMENTS

| | | |
|---|---|---|
| 2937012 | 4/1980 | Fed. Rep. of Germany . |
| 1395330 | 5/1975 | United Kingdom . |
| 2160098 | 12/1985 | United Kingdom . |

OTHER PUBLICATIONS

JP 54-87710A, WPI abstract, 7/12/79.

*Primary Examiner*—Paul Lieberman
*Assistant Examiner*—A. Beadles-Hay
*Attorney, Agent, or Firm*—Ronald A. Koatz

[57] ABSTRACT

This invention provides a liquid detergent composition comprising:

(a) 5-85% by weight of a surfactant selected from the group consisting of anionic, nonionic, cationic, ampholytic or zwitterionic surfactants and mixtures thereof;

(b) an effective amount of enzyme; and (c) an amount of protein containing quaternary nitrogen substituent sufficient to stabilize the enzyme from loss of activity.

19 Claims, No Drawings

HEAVY DUTY LIQUID DETERGENT COMPOSITIONS CONTAINING ENZYMES STABILIZED BY QUATERNARY NITROGEN SUBSTITUTED PROTEINS

BACKGROUND OF THE INVENTION

1. Field of the Invention

This invention relates to the long term stabilization of an enzyme contained in detergent compositions using proteins containing quaternary nitrogen substituents.

2. Prior Art

The desirability of using enzymes in cleaning compositions is well known. Lipase enzymes, for example, are useful for their ability to reduce macromolecules such as fats into smaller glycerol and fatty acid components which can be readily washed away by detergents and/or water. Detergent compositions containing these enzymes are capable of removing fatty stains. Protease enzymes, for example, are useful for their ability to reduce proteinaceous stain which can then also be readily washed away.

The stability of enzymes, e.g., lipases and proteases, in current liquid detergent compositions, however, is generally poor due to various reasons. First, the surfactant found in such detergent compositions induces denaturation of the enzyme. Second, when a protease is present in the composition, the protease will cause proteolytic digestion of the other enzyme, if it is not a protease, or of itself in a process called autolysis.

Proteins, such as those taught in U.S. Pat. No. 4,842,758 to Crutzen (Colgate-Palmolive) and U.S. Pat. No. 4,842,767 to Warschewski et al (Colgate-Palmolive), are known to improve enzyme stability in heavy duty liquids (HDLs). There is no teaching in these patents, however, of the use of proteins containing quaternary nitrogen substituents for enzyme stabilization.

Other approaches used for stabilization of enzymes in HDLs include the use of aminated polysaccharides such as taught in U.S. Pat. No. 4,011,169; the use of calcium and carboxylic acids (preferably formate) such as disclosed in U.S. Pat. Nos. 4,305,837, 4,490,285 and 4,537,707; the use of calcium with alkyl diacids (succinic, adipic) such as disclosed in U.S. Pat. No. 4,529,525; and the use of aliphatic glycols with and without boron containing compounds such as taught in U.S. Pat. Nos. 3,819,528, 4,462,922, 4,404,115 and 4,652,394.

West German published patent application No. P 29 37 012.5 (Henkel) teaches agents for stabilizing enzymes which are the protein reaction products of (1) ammonia or primary or secondary amines containing up to 20 carbon atoms and/or (2) aliphatic epoxides containing 2 to 18 carbon atoms to protein substrates. Proteins used as substrates for addition of these groups include gelatin, collagen, zein, casein, soy protein and other plant proteins as well as so-called single-cell proteins. Gelatin, collagen or casein are said to be preferred.

The Henkel application teaches only the use of primary or secondary amines compared to the tertiary or quaternary amines used in the invention.

SUMMARY OF THE INVENTION

It has now been found that the use of proteins containing quaternary nitrogen substituents, i.e., the reaction product of these proteins and tertiary or quaternary amines provides significantly improved enzyme stability in HDL formulations.

In particular, the present invention provides a heavy duty liquid detergent composition containing a stabilized enzyme which composition comprises:

(1) at least one of an anionic, nonionic, cationic, ampholytic or zwitterionic surfactant or a mixture of these surfactants in an amount of 5–85% by weight;

(2) an effective amount of enzyme; and (3) an amount of a protein containing quaternary nitrogen substituent sufficient to stabilize the enzyme from loss of activity.

In one embodiment of the invention, the enzyme to be stabilized is a lipase enzyme in which case there is used an effective amount of lipase enzyme as compound (2) and an amount of protein containing quaternary nitrogen substituent sufficient to stabilize the lipase enzyme from loss of activity as component (3). In another embodiment of the invention, the enzyme to be stabilized is a protease enzyme in which case component (2) is a protease and sufficient protein containing quaternary nitrogen substituent to stabilize the protease from loss of activity is used as component (3).

Optional ingredients which may be added to the composition include, but are not limited to, detergent enzymes other than lipase or protease (such as cellulases, oxidases, amylases and the like), builders, additional enzyme stabilizers (such as formic acid, low levels of calcium, polyols and boron-containing components), alkalinity buffers, hydrotropes, cationic softening agents, soil release polymers, antiredeposition agents and other ingredients such as are known in the art.

DETAILED DESCRIPTION OF THE INVENTION

The present invention relates to HDL formulations containing enzymes and further containing proteins containing quaternary nitrogen substituents used to stabilize the enzymes in the formulation.

The heavy duty liquid (HDL) detergent compositions comprise (1) a surfactant detergent comprising at least one of an anionic, nonionic, cationic, ampholytic or zwitterionic surfactants or a mixture of any of these surfactant detergents; (2) an effective amount of enzyme; and (3) an amount of protein containing quaternary nitrogen substituent sufficient to stabilize the enzyme from loss of activity.

Surface Active Detergents

The laundry detergent composition may contain one or more surface active agents selected from the group consisting of anionic, nonionic, cationic, ampholytic and zwitterionic surfactants or mixtures thereof. The preferred surfactant detergents for use in the present invention are mixtures of anionic and nonionic surfactants although it is to be understood that any surfactant may be used alone or in combination with any other surfactant or surfactants.

Anionic Surfactant Detergents

Anionic surface active agents which may be used in the present invention are those surface active compounds which contain a long chain hydrocarbon hydrophobic group in their molecular structure and a hydrophile group, i.e. water solubilizing group such as sulfonate or sulfate group. The anionic surface active agents include the alkali metal (e.g. sodium and potassium) water soluble higher alkyl benzene sulfonates, alkyl sulfonates, alkyl sulfates and the alkyl poly ether sulfates. The preferred anionic surface active agents are the alkali metal higher alkyl benzene sulfonates and alkali metal higher alkyl sulfonates. Preferred higher alkyl sulfonate are those in which the alkyl groups contain 8 to 26 carbon atoms, preferably 12 to 22 carbon atoms and more preferably 14 to 18 carbon atoms. The alkyl group in the alkyl benzene sulfonate preferably contains 8 to 16 carbon atoms and more preferably 10 to 15 carbon atoms. A particularly preferred alkyl benzene sulfonate is the sodium or potassium dodecyl benzene sulfonate, e.g. sodium linear dodecylbenzene sulfonate. The primary and secondary alkyl sulfonates can be made by reacting long chain alpha-olefins with sulfites or bisulfites, e.g. sodium bisulfite. The alkyl sulfonates can also be made by reacting long chain normal paraffin hydrocarbons with sulfur dioxide and oxygen as described in U.S. Pat. Nos 2,503,280, 2,507,088, 3,372,188 and 3,260,741 to obtain normal or secondary higher alkyl sulfonates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the 2-carbon atoms of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfonates can be used as well as mixtures of higher alkyl benzene sulfonates and higher alkyl polyether sulfates.

The alkali metal alkyl benzene sulfonate can be used in an amount of 0 to 70%, preferably 10 to 50% and more preferably 10 to 20% by weight.

The alkali metal sulfonate can be used in admixture with the alkylbenzene sulfonate in an amount of 0 to 70%, preferably 10 to 50% by weight.

The higher alkyl polyether sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl poly ethoxy sulfates used in accordance with the present invention are represented by the formula.

$$R^1—O(CH_2CH_2O)_p—SO_3M,$$

where $R^1$ is a $C_8$ to $C_{20}$ alkyl, preferably $C_{10}$ to $C_{18}$ and more preferably $C_{12}$ to $C_{15}$; p is 2 to 8, preferably 2 to 6, and more preferably 2 to 4; and M is an alkali metal, such as sodium and potassium, and ammonium cation. The sodium and potassium salts are preferred.

A preferred higher alkyl poly ethoxylated sulfate is the sodium salt of a triethoxy $C_{12}$ to $C_{15}$ alcohol sulfate having the formula $$C_{12-15}—O—(CH_2CH_2O)_3—SO_3Na$$

Examples of suitable higher alkyl poly lower alkoxy sulfates that can be used in accordance with the present invention are $C_{12-15}$ normal or primary alkyl triethenoxy sulfate, sodium salt; n-decyl diethenoxy sulfate, sodium salt; $C_{12}$ primary alkyl diethenoxy sulfate, ammonium salt; $C_{12}$ primary alkyl triethoxy sulfate, sodium salt; $C_{15}$ primary alkyl tetraethenoxy sulfate, sodium salt, mixed $C_{14-15}$ normal primary alkyl mixed tri- and tetraethenoxy sulfate, sodium salt; stearyl pentaethenoxy sulfate, sodium salt; and mixed $C_{10-18}$ normal primary alkyl triethenoxy sulfate, potassium salt.

The normal alkyl poly-lower alkoxy sulfates are readily biodegradable and are preferred. The alkyl poly-lower alkoxy sulfates can be used in mixtures with each other and/or in mixtures with the above discussed higher alkyl benzene and higher alkyl sulfonates.

The alkali metal higher alkyl poly ethoxylate sulfate can be used with the alkylbenzene sulfonate and/or with the alkyl sulfonate, in an amount of 0 to 70%, preferably 10 to 50% and more preferably 10 to 20% by weight of entire composition.

Nonionic Surfactant Detergent

Nonionic synthetic organic detergents which can be used with the invention, alone or in combination with other surfactants are described below.

As is well known, the nonionic synthetic organic detergents are characterized by the presence of an organic hydrophobic group and an organic hydrophillic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929.

Usually, the nonionic detergents are poly-lower alkoxylated lipophiles wherein the desired hydrophile-lipophile balance is obtained from addition of a hydrophilic poly-lower alkoxy group to a lipophilic moeity. A preferred class of the nonionic detergent employed is the poly-lower alkoxylated higher alkanol wherein the alkanol is of 9 to 18 carbon atoms and wherein the number of moles of lower alkylene oxide (of 2 or 3 carbon atoms) is from 3 to 12. Of such materials it is preferred to employ those wherein the higher alkanol is a higher fatty alcohol of 9 to 11 or 12 to 15 carbon atoms and which contain from 5 to 8 or 5 to 9 lower alkoxy groups per mole.

Exemplary of such compounds are those wherein the alkanol is of 12 to 15 carbon atoms and which contain about 7 ethylene oxide groups per mol, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide group present averages about 6.5. The higher alcohols are primary alkanols.

Other useful nonionics are represented by the commercially well known class of nonionics sold under the trademark Plurafac. The Plurafacs are the reaction products of a higher linear alcohol and a mixture of ethylene and propylene oxides, containing a mixed chain of ethylene oxide and propylene oxide, terminated by a hydroxyl group. Examples include $C_{13}$-$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed With 5 moles propylene Oxide and 10 moles ethylene oxide or mixtures of any of the above.

Another group of liquid nonionics are commercially available from Shell Chemical Company, Inc. under the Dobanol trademark: Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide per mole of fatty alcohol.

In the compositions of this invention, preferred nonionic surfactants include the $C_{12}$–$C_{15}$ primary fatty alcohols with relatively narrow contents of ethylene oxide in the range of from about 7 to 9 moles, and the C9 to $C_{11}$ fatty alcohols ethoxylated with about 5–6 moles ethylene oxide.

Another class of nonionic surfactants which can be used in accordance with this invention are glycoside surfactants. Glycoside surfactants suitable for use in accordance with the present invention include those of the formula:

$$RO—R^1O—_y(Z)_x$$

wherein R is a monovalent organic radical containing from about 6 to about 30 (preferably from about 8 to about 18) carbon atoms; $R^1$ is a divalent hydrocarbon radical containing from about 2 to 4 carbon atoms; 0 is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1½ to about 10).

A particularly preferred group of glycoside surfactants for use in the practice of this invention includes those of the formula above in which R is a monovalent organic radical (linear or branched) containing from about 6 to about 18 (especially from about 8 to about 18) carbon atoms; y is zero; z is glucose or a moiety derived therefrom; x is a number having an average value of from 1 to about 4 (preferably from about 1½ to 4).

Mixtures of two or more of the nonionic surfactants can be used.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

Ampholytic Surfactants

Ampholytic synthetic detergents can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-solubilizing group, e.g. carboxy, sulfonate, sulfate. Examples of compounds falling within this definition are sodium 3-(dodecylamino)propionate, sodium 3-(dodecylamino)-propane-1-sulfonate, sodium 2-(dodecylamino)ethyl sulfate, sodium 2-(dimethylamino)octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Sodium 3-(dodecylamino)propane-1-sulfonate is preferred.

Zwitterionic Surfactants

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The total surfactant concentration used in the compositions of the invention ranges from about 5 to about 80%, preferably 10–40% by weight.

ENZYMES

In one embodiment of the invention, the enzyme which is to be stabilized is a lipolytic enzyme.

The lipolytic enzyme used in this embodiment of the invention may be either a fungal lipase producible by *Humicola lanuginosa* and *Thermomyces lanuginosus*, or a bacterial lipase which show a positive immunological cross-reaction with the antibody of the lipase produced by the microorganism *Chromobacter viscosum* var. *lipolyticum* NRRL B-3673. This microorganism has been described in Dutch patent specification 154 269 of Toyo Jozo Kabushiki Kaisha and has been deposited with the Fermentation Research Institute, Agency of Industrial Science and Technology, Ministry of International Trade and Industry, Tokyo, Japan, and added to the permanent collection under nr. KO Hatsu Ken Kin Ki 137 and is available to the public at the United States Department of Agriculture, Agricultural Research Service, Northern Utilization and Development Division at Peoria, Ill., USA, under the nr. NRRL B-3673. The lipase produced by this microorganism is commercially available from Toyo Jozo Co., Tagata, Japan, hereafter referred to as "TJ lipase". These bacterial lipases should show a positive immunological cross-reaction with the TJ lipase antibody, using the standard and well-known immunodiffusion procedure according to Ouchterlony (Acta. Med. Scan., 133, pages 76–79 (1950).

The preparation of the antiserum is carried out as follows:

Equal volumes of 0.1 mg/ml antigen and of Freund's adjuvant (complete or incomplete) are mixed until an emulsion is obtained. Two female rabbits are injected with 2 ml samples of the emulsion according to the following scheme:

day 0: antigen in complete Freund's adjuvant
day 4: antigen in complete Fruend's adjuvant
day 32: antigen in incomplete Freund's adjuvant
day 60: booster of antigen in incomplete Freund's adjuvant The serum containing the required antibody is prepared by centrifugation of clotted blood, taken on day 67.

The titre of the anti-TJ-lipase antiserum is determined by the inspection of precipitation of serial dilutions of antigen and antiserum according to the Ouchterlony procedure. A $2^5$ dilution of antiserum was the dilution that still gave a visible precipitation with an antigen concentration of 0.1 mg/ml.

All bacterial lipases showing a positive immunological cross-reaction with the TJ-lipase antibody as hereabove described are lipases suitable in this embodiment of the invention. Typical examples thereof are the lipase ex *Pseudomonas fluorescens* IAM 1057 available from Amano Pharmaceutical Co., Nagoya, Japan, under the trade-name Amano-P lipase, the lipase ex *Pseudomonas fragi* FERM P 1339 (available under the trade-name Amano-B), the lipase ex *Pseudomonas nitroreducens* var. *lipolyticum* FERM P 1338, the lipase ex *Pseudomonas sp.* available under the trade-name Amano CES, the lipase ex *Pseudomonas cepacia.* lipases ex *Chrombacter viscosum.* e.g. *Chrombacter viscosum* var. *lipolyticum* NRRL B-3673, commercially available from Toyo Jozo Co., Tagata, Japan; and further *Chrombacter viscosum* lipases from U.S. Biochemical Corp. USA and Diosynth Co., The Netherlands, and lipases ex *Pseudomonas gladioli.*

An example of a fungal lipase as defined above is the lipase ex *Humicola lanuginosa,* available from Amano under the trade-name Amano CE; the lipase ex *Humicola lanuginosa* as described in the aforesaid European Patent Application 0258,068 (NOVO), as well as the lipase obtained by cloning the gene from *Humicola lanuginosa* and expressing this gene in *Aspergillus oryzae,* commercially available from NOVO Industri A/S under the trade name "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/ml in the wash cycle, preferably 25 to 0.05 LU/ml when the formulation is dosed at a level of about 2 gm/liter.

A lipase Unit (LU) is that amount of lipase which produces 1/μmol of titratable fatty acid per minute in a pH stat under the following conditions: temperature 30° C.; pH=9.0; substrate is an emulsion of 3.3 wt. % of olive oil and 3.3% gum arabic, in the presence of 13 mmol/1 $Ca^{2+}$and 20 mmol/1 NaCl in 5 mmol/1 Tris-buffer.

Naturally, mixtures of the above lipases can be used. The lipases can be used in their non-purified form or in a purified form, e.g. purified with the aid of well-known absorption methods, such as phenyl sepharose absorption techniques.

Compositions of this embodiment of the invention which contain lipase may additionally comprise a proteolytic enzyme. Indeed, it has been found that one of the benefits of the proteins containing quaternary nitrogen substituents of the present invention is that they can stabilize lipase towards degradation by protease. Proteases added to this embodiment of the invention can be of vegetable, animal or microorganism origin. Preferably, it is of the latter origin, which includes yeasts, fungi, molds and bacteria. Particularly preferred are bacterial subtilisin type proteases, obtained from e.g. particular strains of B. subtilis and B. licheniformis. Examples of suitable commercially available proteases are Alcalase, Savinase, Esperase, all of NOVO Industri a/S; Maxatase and Maxacal of Gist-Brocades; Kazusase of Showa Denko; BPN and BPN' proteases and so on. The amount of proteolytic enzyme, included in the composition, ranges from 0.1–50 GU/mg, based on the final composition. Naturally, mixtures of different proteolytic enzymes may be used in combination with the lipase in this embodiment of the invention.

A GU is a glycine unit, which is the amount of proteolytic enzyme which under standard incubation conditions produces an amount of terminal $NH_2$ -groups equivalent to 1 microgramme/ml of glycine.

In a second embodiment of the invention, the enzyme to be stabilized by the proteins containing quaternary nitrogen substituents of the invention is a protease or proteolytic enzyme. The proteolytic enzyme used in this embodiment of the invention can be of vegetable, animal or microorganism origin. Preferably, it is of the latter origin, which includes yeasts, fungi, molds and bacteria. Particularly preferred are bacterial subtilisin type proteases, obtained from e.g. particular strains of B. subtilis and B. lichniformis. Examples of suitable commercially available proteases are Alcalase, Savinase, Esperase, all of NOVO Industri a/S; Maxatase and Maxacal of Gist-Brocades; Kazusase of Showa Denko; BPN and BPN' proteases and so on. The amount of proteolytic enzyme, included in the composition, ranges from 0.05–50,000 GU/mg, preferably 0.1 to 50 GU/mg, based on the final composition. Naturally, mixtures of different proteolytic enzymes may be used.

While various specific enzymes have been described above, it is to be understood that any protease which can confer the desired proteolytic activity to the composition may be used and this embodiment of the invention is not limited in any way by specific choice of proteolytic enzyme.

In addition to lipases or proteases, it is to be understood that other enzymes such as cellulases, oxidases, amylases and the like which are well known in the art may also be used with the compositions of the invention.

Enzyme Stabilizer

The enzyme stabilizing material constituent of the present invention is a protein containing a quaternary nitrogen substituent. This protein is the reaction product of a protein and a tertiary or quaternary amine. Examples of preferred stabilizers which may be used include cationic hydrolyzed collagen, casein, keratin, wheat protein (e.g. wheat germ), silk protein, soy, corn gluten and the like.

While not wishing to be bound by theory, it is believed that the quaternary nitrogen group is superior to prior art proteins having primary or secondary amine groups attached because of the enhanced positive change. It is believed this enhanced positive charge is more readily able to stabilize the negative charge on the enzyme when used at the pH ranges of the composition.

The quaternized stabilizer protein has the structure defined below:

$$\text{Protein—Y—R}_1\text{—}^{+}(R_2)(R_3)(R_4)A\text{—}$$

where Protein is a native or hydrolyzed protein such as collagen, casein, keratin, silk protein, wheat protein, soy or corn gluten.

Y is a reactive amino acid such as serine, lysine, hydroxylysine, arginine, threonine, histidine, or tyrosine;

$R_1$ is a saturated or unsaturated alkyl, aryl, alkaryl, amido, alkylamine, alkoxy or alkanol group having 0 to 20 carbon atoms;

$R_2$, $R_3$ and $R_4$ are saturated or unsaturated alkyl, aryl, amido, alkylamine, alkoxy, alkanol, alkylcarboxylate, alkyl sulfate, alkylsulfonate, arylsulfonate or arylsulfate groups having 1 to 20 carbon atoms; and $A^-$ is a neutralizing anion such as a halide (Cl, Br), sulfate, organic sulfate (e.g., ethosulfate), organic acid (e.g., acetate), hydroxy acid (e.g., lactic acid), or a combination thereof.

Preferably $R_2$, $R_3$ and $R_4$ are alkyl groups having 1 to 20 carbon atoms.

Specific examples of proteins which may be used include triethonium hydrolyzed collagen (Quat Pro E) having the structure:

$$\text{collagen-Y—}\overset{CH_3CH_2SO_4^-}{\overset{+}{N}}\text{—}(CH_2CH_3)_3$$

and steartrimonium hydrolyzed collagen (Quat Pro S) having the structure:

$$\text{collagen-Y—}\overset{Cl^-}{\overset{+}{N}}(CH_3)_2C_{18}H_{37}$$

Both are manufactured by Amerchol. Quat Coll QS (having a $C_{18}$ alkyl chain like Quat Pro S) is manufactured by Brooks.

The protein is used at a level sufficient to stabilize the enzyme used in the compositions of the invention from loss of activity. The amount used is generally about 0.01 to about 10%, preferably 0.1 to 2%, by weight, of the composition.

By this invention, applicants have discovered that adding a protein containing quaternary nitrogen group, unexpectedly increases the stability of the enzyme to a much higher level than would be otherwise contemplated.

Other Optional Ingredients

The surfactants used in the compositions of the present invention may also have dispersed, suspended, or dissolved therein fine particles of inorganic and/or organic detergent builder salts.

The invention detergent compositions may include water soluble and/or water insoluble detergent builder salts. Water soluble inorganic alkaline builder salts which can be used alone with the detergent compound or in admixture with other builders are alkali metal carbonates, bicarbonates, borates, phosphates, polyphosphates, and silicates. (Ammonium or substituted ammonium salts can also be used.) Specific examples of such salts are sodium tripolyphosphate, sodium carbonate, sodium pyrophosphate, potassium pyrophosphate, sodium bicarbonate, potassium tripolyphosphate, sodium hexametaphosphate, sodium sesquicarbonate, sodium mono and diorthophosphate, and potassium bicarbonate. Sodium tripolyphosphate (TPP) is especially preferred.

The polyphosphate builder (such as sodium tripolyphosphate) can be supplemented with suitable organic auxiliary builders.

Suitable organic builders are polymers and copolymers of polyacrylic acid and polymaleic anhydride and the alkali metal salts thereof. More specifically such builder salts can consist of a copolymer which is the reaction product of acrylic acid and maleic anhydride which has been completely neutralized to form the sodium salt thereof. One example of such a compound is the builder commercially available under the tradename of Sokalan CP5. This builder serves when used even in small amounts to inhibit incrustation.

Examples of organic alkaline sequestrant builder salts which can be used with the detergent builder salts or in admixture with other organic and inorganic builders are alkali metal, ammonium or substituted ammonium, aminopolycarboxylates, e.g. sodium and potassium ethylene diaminetetraacetate (EDTA), sodium and potassium nitrilotriacetates (NTA), and triethanolammonium N-(2 hydroxyethyl)nitrilodiacetates. Mixed salts of these aminopolycarboxylates are also suitable.

Other suitable builders of the organic type include carboxylmethylsuccinates, e.g., methyloxysuccinate (CMOS);, tartronates glycollates; tartrate monosuccinate, tartrate disuccinate or mixtures thereof (TMS/TDS); citrate; and small polycarboxylates. Of special value are the polyacetal carboxylates. The polyacetal carboxylates and their use in detergent compositions are described in U.S. Pat. Nos. 4,144,226, 4,315,092 and 4,146,495.

The inorganic alkali metal silicates are useful builder salts which also function to adjust or control the pH and to make the composition anticorrosive to washing machine parts. Sodium silicates of $Na_2O/SiO_2$ ratios of from 1.6/1 to 1/3.2, especially about ½ to 1/2.8 are preferred. Potassium silicates of the same ratios can also be used.

The water insoluble crystalline and amorphous aluminosilicate zeolite builders can be used. The zeolites generally have the formula $$(M_2O)_x(Al_2O_3)_y(SiO_2)_zwH_2O$$

wherein x is 1, y is from 0.8 to 1.2 and preferably, 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq per gram.

Various crystalline zeolites (i.e. alumino-silicates) that can be used are described in British Pat. No. 1,504,168, U.S. Pat. No. 4,409,136 and Canadian pats. Nos. 1,072,835 and 1,087,477, all of which are hereby incorporated by reference for such descriptions. An example of amorphous zeolites useful herein can be found in Belgium Pat. No. 835,351 and this patent too is incorporated herein by reference.

Alkalinity buffers which may be added to the compositions of the invention include monoethanolamine, triethanolamine, borax and the like.

Hydrotropes which may be added to the invention include ethanol, sodium xylene sulfonate, sodium cumene sulfonate and the like.

Other materials such as clays, particularly of the water-insoluble types, may be useful adjuncts in compositions of this invention. Particularly useful is bentonite. This material is primarily montmorillonite which is a hydrated aluminum silicate in which about 1/6th of the aluminum atoms may be replaced by magnesium atoms and with which varying amounts of hydrogen, sodium, potassium, calcium, etc. may be loosely combined. The bentonite in its more purified form (i.e. free from any grit, sand, etc.) suitable for detergents contains at least 50% montmorillonite and thus its cation exchange capacity is at least about 50 to 75 meq per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Pat. No. 401,413 to Marriott and British Pat. No. 461,221 to Marriott and Guan.

In addition, various other detergent additives or adjuvants may be present in the detergent product to give it additional desired properties, either of functional or aesthetic nature.

Improvements in the physical stability and anti-settling properties of the composition may be achieved by the addition of a small effective amount of an aluminum salt of a higher fatty acid, e.g. aluminum stearate, to the composition. The aluminum stearate stabilizing agent can be added in an amount of 0 to 3%, preferably 0.1 to 2.0% and more preferably 0.5 to 1.5%.

There also may be included in the formulation, minor amounts of soil suspending or anti-redeposition agents, e.g. polyvinyl alcohol, fatty amides, sodium carboxymethyl cellulose, hydroxy-propyl methyl cellulose. A preferred anti-redeposition agent is sodium carboxylmethyl cellulose having a 2:1 ratio of CM/MC which is sold under the tradename Relatin DM 4050.

Optical brighteners for cotton, polyamide and polyester fabrics can be used. Suitable optical brighteners include Tinopal LMS-X, stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dimorpholine dianilino stilbene sulfonate.

Anti-foam agents, e.g. silicon compounds, such as Silicane L 7604, can also be added in small effective amounts.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/572 and ultramarine blue can be used.

Also, soil release polymers and cationic softening agents may be used.

The list of optional ingredients above is not intended to be exhaustive and other optional ingredients which may not be listed but which are well known in the art may also be included in the composition.

The viscosity of the present aqueous liquid detergent composition can be in the range of 50 to 20000 centipoises, preferably 100 to 1000 centipoises, but products of other suitable viscosities can also be useful. At the viscosities mentioned, the liquid detergent is a stable dispersion/emulsion and is easily pourable. The pH of the liquid detergent dispersion/emulsion depends in part on the enzyme which is stabilized. For lipase stabilization, pH is in the range of 5 to 11.5, preferably 6 to 10 and for protease stabilization, pH is in the range of 6 to 12.5, preferably 8 to 11, more preferably 9 to 11.

The present invention is further illustrated by the following examples. The examples are not intended to be limiting in any way.

EXAMPLE 1

Anionic Rich Formulation without Protease

The stability of lipase in the examples containing lipase was determined by measuring the lipase activity (pH stat and pNPV methods) as a function of time of storage at 37° C. Half-lives were determined by plotting $\ln[A_O/A_t]$ versus time (where $A_O$=initial activity and $A_t$=activity at time t) and performing a linear regression.

Stability of protease in examples containing protease was determined by measuring the protease activity (tetrapeptide method) as a function of time of storage at 37° C. Half-lives were determined by plotting $\ln[A_O/A_t]$ versus time (where $A_O$=initial activity and At=activity at time t) and performing a linear regression.

Compositions of one example containing lipase are given below:

| Ingredients | Composition (wt. %) | | |
|---|---|---|---|
| | 1.1 | 1.2 | 1.3 |
| Sodium $C_{11}$ Alkyl Benzene sulfonate | 10.0 | 10.0 | 10.0 |
| Neodol 25-9 | 8.0 | 8.0 | 8.0 |
| Neodol 25-3S | 6.0 | 6.0 | 6.0 |
| Sodium Xylene Sulfonate | 3.0 | 3.0 | 3.0 |
| Citric Acid | 7.0 | 7.0 | 7.0 |
| TEA | 2.0 | 2.0 | 2.0 |
| MEA | 2.0 | 2.0 | 2.0 |
| Stearic Acid | 0.08 | 0.08 | 0.08 |
| Sodium Hydroxide | Neutralize to pH = 7 | | |
| Lipolase | 3.0 | 3.0 | 3.0 |
| Water | to 100% | | |
| Quat Pro E (Amerchol) | 2.0 | 0.0 | 0.0 |
| Quat Pro S (Amerchol) | 0.0 | 2.0 | 0.0 |
| Stability: $t_{\frac{1}{2}}$ (days) | 14.6 | 15.4 | 12.2 |
| % Improved Stability | 19.7 | 26.2 | — |

The addition of 2% cationic protein hydrolysate improves $t_{\frac{1}{2}}$ compared to the control. Specifically, Quat Pro E showed an improvement of about 19.7% (2.4/12.2). Quat Pro S showed improvement of about 26.2% (3.2/12.2). Quat Pro E is a triethonium hydrolyzed collagen, and Quat Pro S is a steartrimonium hydrolyzed collagen, both manufactured by Amerchol.

Neodol 25-9 is a non-ionic surfactant having about 9 ethylene oxide groups per mol.

Neodol 25-3S is a sodium $C_{12}$–$C_{15}$ alkyl triethoxy sulfate available from Shell.

TEA is triethanolamine.

MEA is monoethanolamine.

EXAMPLE 2

Nonionic Rich Formulation Containing Lipase and Gelatin compared to formulation with Lipase and Cationic Hydrolyzed Protein The following liquid detergent compositions were prepared and evaluated for lipase stability at 37° C:

| Ingredients | Composition (wt. %) | | | | | |
|---|---|---|---|---|---|---|
| | 2.1 | 2.2 | 2.3 | 2.4 | 2.5 | 2.6 |
| Neodol 25-9 | 16.5 | 16.5 | 16.5 | 16.5 | 16.5 | 16.5 |
| Sodium $C_{11}$ Alkyl Benzene Sulfonate | 3.5 | 3.5 | 3.5 | 3.5 | 3.5 | 3.5 |
| Ethanol | 5.0 | 5.0 | 5.0 | 5.0 | 5.0 | 5.0 |
| Sodium Formate | 2.7 | 2.7 | 2.7 | 2.7 | 2.7 | 2.7 |
| Alcalase 2.5 L | 0.75 | 0.75 | 0.75 | 0.75 | 0.75 | 0.75 |
| Lipolase | 3.0 | 3.0 | 3.0 | 3.0 | 3.0 | 3.0 |
| Water | to 100% | | | | | |
| Quat Pro E | 0.0 | 1.0 | 0.0 | 0.0 | 0.0 | 0.0 |
| Gelatin A300 | 0.0 | 0.0 | 1.0 | 0.0 | 0.0 | 0.0 |
| Gelatin A175 | 0.0 | 0.0 | 0.0 | 1.0 | 0.0 | 0.0 |
| Gelatin A60 | 0.0 | 0.0 | 0.0 | 0.0 | 1.0 | 0.0 |
| Gelatin Hydrolysate | 0.0 | 0.0 | 0.0 | 0.0 | 0.0 | 1.0 |
| Stability: $t_{\frac{1}{2}}$ (days) | 3 | 13 | 4.2 | 5.0 | 3.5 | 5.1 |
| % Improved Stability | — | 333 | 40 | 67 | 16.7 | 70 |

The various gelatins mentioned above are available from Aldrich Chemical Company.

Adding 1.0 wt. % gelatins of various molecular weights (as defined by bloom strength: 300, 175, or 60) improved lipase stability ($t_{\frac{1}{2}}$=4–5 days) compared to the control ($t_{\frac{1}{2}}$=3 days). Hydrolyzed gelatin also improved stability but unexpectedly the addition of cationic hydrolyzed gelatin (Quat Pro E) resulted in the greatest improvement in stability ($t_{\frac{1}{2}}$=13 days).

This example shows that while hydrolyzed protein alone shows an improvement in lipase stability, unexpectedly the use of a protein containing a quaternary nitrogen substituent (i.e., cationic hydrolyzed protein) improves stability 4–5 times as much as even the best performing gelatin (i.e. 333% versus 70% improvement in stability).

EXAMPLE 3

Nonionic Rich Formulation Containing Lipase and Hydrolyzed Protein Compared to Formulation with Lipase and Cationic Hydrolyzed Protein The following liquid detergent compositions were prepared and evaluated for lipase stability at 37° C.:

| Ingredients | Composition (wt.%) | | | | |
|---|---|---|---|---|---|
| | 3.1 | 3.2 | 3.3 | 3.4 | 3.5 |
| Neodol 25-9 | 16.5 | 16.5 | 16.5 | 16.5 | 16.5 |
| Sodium $C_{11}$ Alkyl Benzene Sulfonate | 3.5 | 3.5 | 3.5 | 3.5 | 3.5 |
| Ethanol | 5.0 | 5.0 | 5.0 | 5.0 | 5.0 |
| Sodium Formate | 2.7 | 2.7 | 2.7 | 2.7 | 2.7 |
| Alcalase 2.5 L | 0.75 | 0.75 | 0.75 | 0.75 | 0.75 |
| Lipolase | 3.0 | 3.0 | 3.0 | 3.0 | 3.0 |
| Water | to 100% | | | | |
| Quat Pro E (Amerchol) | 0.0 | 2.0 | 0.0 | 0.0 | 0.0 |
| Hydro Coll EN-55 (Brooks Ind.) | 0.0 | 0.0 | 2.0 | 0.0 | 0.0 |
| HydroKeratin (Brooks) | 0.0 | 0.0 | 0.0 | 2.0 | 0.0 |
| Solusilk Protein (Brooks Ind.) | 0.0 | 0.0 | 0.0 | 0.0 | 2.0 |
| Stability: $t_{\frac{1}{2}}$ (days) | 1.3 | 6.2 | 2.3 | 1.9 | 2.0 |
| % Improvement in Stability | — | 377 | 77 | 46 | 54 |

-continued

Hydro Coll EN-55 is a hydrolyzed collagen protein.
Hydrokeratin is a hydrolyzed Keratin protein.
Solusilk is a hydrolyzed silk protein.

All the hydrolyzed proteins showed some improvement in lipase stability compared to the control. Again, however, the cationic, hydrolyzed collagen provided the most dramatic improvement in lipase stability.

This example shows that the improvement in lipase stability using a protein containing quaternary nitrogen substituent stabilizer (i.e., cationic hydrolyzed protein) is far higher than the improvement in stability using hydrolyzed proteins which do not have an attached cationic group.

EXAMPLE 4

Nonionic Rich Formulation containing lipase and Cationic Proteins with Hydrophobic Groups of Varying Chain Length The following liquid detergent compositions were prepared and evaluated for lipase stability:

| Ingredient | Composition (wt.%) | | | |
|---|---|---|---|---|
| | 4.1 | 4.2 | 4.3 | 4.4 |
| Neodol 25-9 | 16.5 | 16.5 | 16.5 | 16.5 |
| Sodium $C_{11}$ Alkyl Benzene Sulfonate | 3.5 | 3.5 | 3.5 | 3.5 |
| Ethanol | 5.0 | 5.0 | 5.0 | 5.0 |
| Sodium Formate | 2.7 | 2.7 | 2.7 | 2.7 |
| Alcalase 2.5 L | 0.75 | 0.75 | 0.75 | 0.75 |
| Lipolase | 3.0 | 3.0 | 3.0 | 3.0 |
| Water | to 100% | | | |
| Quat Pro E (Amerchol) | 0.0 | 2.0 | 0.0 | 0.0 |
| Quat Pro S (Amerchol) | 0.0 | 0.0 | 2.0 | 0.0 |
| Quat Coll QS (Books) | 0.0 | 0.0 | 0.0 | 2.0 |
| Stability: $t_{\frac{1}{2}}$ (days) | 2.3 | 7.1 | 3.9 | 3.6 |
| % Improvement in Stability | — | 209 | 70 | 57 |

Varying the alkyl chain of the hydrophobe bearing the pendant quaternary nitrogen appears to affect lipase stability. Addition of Quat Pro E (triethonium hydrolyzed collagen) with three 2-carbon alkyl chains resulted in significantly better stability than Quat Pro S or Quat Coll QS, each with one $C_{18}$ alkyl chain attached to the quaternary nitrogen. The similarity between the results for the stearyl modified proteins from two different suppliers demonstrated that the effect observed was due to the structure of the protein and not intrinsic differences in processing or manufacture.

EXAMPLE 5

Nonionic Rich Formulation Containing Lipase and Albumin

| Ingredient | Composition (wt.%) | |
|---|---|---|
| | 5.1 | 5.2 |
| Neodol 25-9 | 16.5 | 16.5 |
| Sodium $C_{11}$ Alkyl Benzene Sulfonate | 3.5 | 3.5 |
| Ethanol | 5.0 | 5.0 |
| Sodium Formate | 2.7 | 2.7 |
| Alcalase 2.5 L | 0.75 | 0.75 |
| Lipolase | 3.0 | 3.0 |
| Water | to 100% | |

-continued

| Ingredient | Composition (wt.%) 5.1 | 5.2 |
|---|---|---|
| Bovine Serum Albumin (Sigma) | 0.0 | 1.0 |
| Stability: $t_{\frac{1}{2}}$ (days) | 3.0 | 5.8 |
| % Improvement in Stability | — | 93 |

The addition of 1% BSA slightly improved the half-life of lipolase.

EXAMPLE 6

Nonionic Rich Formulation Containing Lipase and Denatured Protease or Casein The following samples were prepared and evaluated for lipase stability:

| Ingredient | Composition (wt.%) 6.1 | 6.2 | 6.3 |
|---|---|---|---|
| Neodol 25-9 | 16.5 | 16.5 | 16.5 |
| Sodium $C_{11}$ Alkyl Benzene Sulfonate | 3.5 | 3.5 | 3.5 |
| Ethanol | 5.0 | 5.0 | 5.0 |
| Sodium Formate | 2.7 | 2.7 | 2.7 |
| Savinase | 0.375 | 0.375 | 0.375 |
| Lipolase | 3.0 | 3.0 | 3.0 |
| Water | | to 100% | |
| Heat Denatured Savinase | 0.0 | 0.375 | 0.0 |
| Milk Powder (Casein) | 0.0 | 0.0 | 1.0 |
| Stability $t_{\frac{1}{2}}$ (days) | 6.0 | 7–8 | 8–9 |
| % Improvement in Stability | — | 33 | 50 |

The stability of lipolase is only slightly increased by the addition of heat denatured protease or milk powder (casein) at these levels.

EXAMPLE 7

German published patent application No. 29 37 012.5 (Henkel) discloses the use of reaction products of proteins (collagen, casein, etc.) and ammonia or primary or secondary amines as enzyme stabilizers in HDLs. The proteins produced do not contain quaternary nitrogen substituents. Since the subject invention involves the use of proteins containing quaternary nitrogen substituents (prepared by reacting tertiary or quaternary amines with proteins) as enzyme stabilizers, it was decided to prepare an example from the German application and compare its lipase stabilizing properties (one aspect of the invention) to the stabilizing properties of the proteins of the invention.

Preparation of Casein+Ethylenediamine Adduct

The casein+ethylenediamine adduct taught in German published application No. 29 37 012.5 was prepared for comparison. The procedure used was nearly identical to what was disclosed in the reference. 150 g of casein was allowed to swell in 80 ml of water at 95° C. in a heat kneader. 30 g ethylenediamine was added to the swollen protein and the reaction mixture was kneaded for 50 minutes at 95° C. 200 ml water was added to the hot reaction product to obtain a viscous solution, rather than a paste. 500 ml isopropyl alcohol was added to the hot reaction product, and the product was allowed to crystallize at 4° C. overnight. The precipitate was then washed with isopropyl alcohol and recrystallized from an isopropyl alcohol/water solvent system. The reaction product was dried in a vacuum oven overnight.

Evaluation of Lipase Stability

The lipase stabilizing properties of the casein+ethylenediamine adduct was compared to examples of hydrolyzed and cationic proteins. The following liquid detergent compositions were prepared and evaluated for lipase stability at 37° C:

| Ingredient | wt. % |
|---|---|
| Neodol 25-9* | 16.5 |
| Sodium $C_{11}$ Alkyl Benzene sulfonate | 3.5 |
| Ethanol | 5.0 |
| Sodium Formate | 2.7 |
| Alcalase 2.5 L | 0.75 |
| Lipase Enzyme | 3.0 |
| Protein | 1.0 |
| Sodium Hydroxide | to pH = 7 |
| Water | to 100% |

*non-ionic surfactant

The half-life time ($t_{\frac{1}{2}}$) of the lipase in the compositions was determined by plotting in ($A_O/A_t$) vs. time (where $A_O$=initial enzyme activity and $A_t$=enzyme activity at time=t) and performing a linear regression and analysis. The results and a description of the proteins are presented below:

| Example | Protein | $t_{\frac{1}{2}}$ (days) | Comments |
|---|---|---|---|
| Comp. 1 | Control | 2.6 | |
| Comp. 2 | Casein | 3.6 | Native Protein |
| Comp. 3 | From German Applic. | 3.3 | Casein + ethylendiamine reaction product |
| 7.1 | Mackpro NSP | 6.8 | Cationic silk protein McIntyre Chemical |
| 7.2 | Mackpro NLW | 6.5 | Cationic wheat protein McIntyre Chemical |
| Comp. 4 | Mackpro NLP | 3.2 | Hydrolyzed collagen McIntyre Chemical |
| 7.3 | Mackpro KLP | 4.4 | Cationic keratin McIntyre Chemical |

Mackpro NSP, NLW and KLP are defined as follows:

Mackpro NSP - oleyl/palmityl/palmitoleamidopropyl silk hydoxypropyl dimonium chloride $$\text{silk-NH}-\text{CH}_2\text{CH}_2\text{CH(OH)}-\overset{\overset{\text{Cl}^-}{|}}{\overset{+}{\text{N}}}(\text{CH}_3)_2\text{CH}_2\text{CH}_2\text{CH}_2\text{NH}\overset{\overset{\text{O}}{\|}}{\text{C}}-\text{C}_{15}\text{H}_{31} \text{ to } \text{C}_{17}\text{H}_{35}$$

Mackpro NLW - oleyl/palmityl/palmitoleamidopropyl wheat hydroxypropyldimonium chloride $$\text{wheat germ-NH}-\text{CH}_2\text{CH}_2\text{CH(OH)}-\overset{\overset{\text{Cl}^-}{|}}{\overset{+}{\text{N}}}(\text{CH}_3)_2-\text{CH}_2\text{CH}_2\text{CH}_2\text{NH}\overset{\overset{\text{O}}{\|}}{\text{C}}-\text{C}_{15}\text{H}_{31} \text{ to } \text{C}_{17}\text{H}_{35}$$

-continued

Mackpro KLP - oleyl/palmityl/palmitoleyl keratin hydroxypropyl dimonium chloride/lactate $$Cl^-_{+} \text{ and } CH_3CH(OH)COO^-$$

$$\text{keratin-NH}-CH_2CH_2CH(OH)N(CH_3)_2-C_{16}H_{33} \text{ to } C_{18}H_{37}$$

The addition of native or hydrolyzed proteins (Comp. 1, 2 and 4) or the example from the german application (Comp. 3) resulted in only a slight increase in lipase stability ($t_{\frac{1}{2}}$) is about 3.5 days vs. 2.5 days), while the cationic proteins (Example 7.1–7.3) significantly improved lipase stability in these compositions. These results show significant improvement in lipase stability obtained with the cationic proteins compared to the prior art.

EXAMPLE 8

An example of a composition containing protease without lipase which may be used is given below:

| Ingredients | Composition (wt. %) |
|---|---|
| Sodium $C_{11}$ Alkyl Benzene sulfonate | 10.0 |
| Neodol 25-9 | 8.0 |
| Neodol 25-3S | 6.0 |
| Sodium Xylene Sulfonate | 3.0 |
| Citric Acid | 7.0 |
| TEA | 2.0 |
| MEA | 2.0 |
| Stearic Acid | 0.08 |
| Sodium Hydroxide | to pH = 10 |
| Savinase | 0.375 |
| Protein | 1.0 |
| Calcium Chloride | 0.04 |
| Water | to 100 |

Neodol 25-9 is a non-ionic surfactant having about 9 ethylene oxide groups per mol.

Neodol 25-3S is a sodium $C_{12}$–$C_{15}$ alkyl triethoxy sulfate available from Shell.

TEA is triethanolamine.

MEA is monoethanolamine.

Protease Stability

The results of various protein with regard to improvement in stability are presented below:

| Protein | $t_{\frac{1}{2}}$ (days at 37° C.) | % Improvement in Stability |
|---|---|---|
| Control (comparative) | 4.7 | — |
| HydroColl EN-55 (comparative) | 6.4 | 36 |
| Quat Pro E | 10.7 | 128 |
| Casein (comparative) | 7.9 | 68 |
| From DE 29,37,012 Applic. (comparative) | 9.1 | 94 |

HydroColl EN-55 is a hydrolyzed collagen protein. Quat Pro E is as defined in the specification above.

The results show that in the presence of calcium, the addition of cationic hydrolyzed collagen (i.e. Quat Pro E) significantly improved Savinase stability (128%). The example from DE 29,37,012 (casein=ethylene diamine) also improved enzyme stability but to a lesser extend (94%). The native and hydrolyzed proteins disclosed as enzyme stabilizers in U.S. Pat. No. 4,842,767 (HydroColl EN-55) and 4,842,758 (casein) only slightly improved enzyme stability.

EXAMPLE 9

Protease Stability in the Absence of Calcium

The effect of added calcium and proteins on enzyme stability was determined by preparing samples of the composition in Example 8 and removing the calcium chloride. The results are presented below:

| Protein | $t_{\frac{1}{2}}$ (days at 37° C.) | % Improvement |
|---|---|---|
| Control | 4.9 | — |
| HydroColl EN-55 (comparative) | 5.0 | — |
| Quat Pro E | 8.5 | 73 |
| Casein (comparative) | 5.9 | 20 |
| From DE 29,37,012 Applic. (comparative) | 6.8 | 38 |

The results are similar to those observed in Example 8, but the improvement in enzyme stability with the cationic collagen is much more apparent. The underivatized proteins had much less of an effect on enzyme stability in the absence of calcium.

We claim:

1. A liquid detergent composition comprising:

(a) 5–85% by weight of a surfactant selected from the group consisting of anionic, nonionic, cationic, ampholytic or zwitterionic surfactants and mixtures thereof;

(b) an effective amount of enzyme selected from the group consisting of protease lipase and mixtures thereof; and (c) about 0.01 to about 10% of a protein containing quaternary nitrogen substituents wherein the protein has the following structure;

$$\text{Protein-Y}-R_1-\overset{+}{N}(R_2)(R_3)(R_4)A^-;$$

wherein Protein is a native or hydrolyzed protein;

Y is a reactive amino acid;

$R_1$ is a saturated or unsaturated alkyl, aryl, alkaryl, amido, alkylamine, alkoxy or alkanol group having 0 to 20 carbon atoms;

$R_2$, $R_3$ and $R_4$ are saturated or unsaturated alkyl, aryl, alkaryl, amido, alkylamine, alkoxy, alkanol, alkylcarboxylate, alkylsulfate, alkylsulfonate, arylsulfonate or arylsulfate groups having 1 to 20 carbon atoms; and $A^-$ is a neutralizing anion.

2. A composition according to claim 1, wherein the enzyme is a lipase enzyme.

3. A composition according to claim 2, wherein the lipase enzyme is a fungal lipase producible by *Humicola lanuginosa* and *Thermomyces lanuginosus* or a bacterial lipase which shows a positive immunological cross-reaction with the antibody of the lipase produced by the microorganism *Chromobacter viscosum* var. lipolyticum NRRL B-3673 ("TJ lipase").

4. A composition according to claim 2, wherein the final composition has a lipolytic enzyme activity of 100 to 0.005 LU/ml in the wash cycle when the formulation is dosed at a level of about 2 gm/liter.

5. A composition according to claim 1, wherein Protein is selected from the group consisting of collagen, casein, keratin, wheat protein, silk protein, soy protein and corn gluten.

6. A composition according to claim 1, wherein $R_2$, $R_3$ and $R_4$ are alkyl groups having 1-20 carbon atoms.

7. A composition according to claim 1, wherein protein is collagen, there is no $R_1$; $R_2$, $R_3$ and $R_4$ are ethyl and $A^-$ is $CH_3CH_2OSO_3-$.

8. A composition according to claim 1, wherein protein is collagen, there is no $R_1$; $R_2$ and $R_3$ are methyl and $R_4$ is stearyl; and $A^-$is $Cl^-$.

9. A composition according to claim 1, wherein the amino aoid is selected from the group consisting of serine, lysine, hydroxylysine, arginine, threonine, histidine and tyrosine.

10. A composition according to claim 1, wherein $A^-$ is selected from the group consisting of halide, sulfate, organic sulfate, organic acid, hydroxy acid or a combination thereof.

11. A composition according to claim 2, additionally comprising 0.1 to 50 GU/mg of a proteolytic enzyme.

12. A composition according to claim 1, wherein the enzyme is a protease enzyme.

13. A composition according to claim 12, wherein the final composition has a proteolytic enzyme activity of 0.05 to 50,000 GU/mg in the wash cycle when the formulation is dosed at a level of about 2 gm/liter.

14. A composition according to claim 12, wherein Protein is selected from the group consisting of collagen, casein, keratin, wheat protein, silk protein, soy protein and corn gluten.

15. A composition according to claim 12, wherein $R_2$, $R_3$ and $R_4$ are alkyl groups having 1-20 carbon atoms.

16. A composition according to claim 12, wherein protein is collagen, there is no $R_1$; $R_2$, $R_3$ and $R_4$ are ethyl; and $A^-$ is $CH_3CH_2OSO_3-$.

17. A composition according to claim 12, wherein protein is collagen, there is no $R_1$; $R_2$ and $R_3$ are methyl; and $R_4$ is stearyl; and $A^-$ is $Cl^-$.

18. A composition according to claim 12, wherein the amino acid Y is selected from the group consisting of serine, lysine, hydroxylysine, arginine, threonine, histidine and tyrosine.

19. A composition according to claim 12, wherein $A^-$ is selected from the group consisting of halide, sulfate, organic sulfate, organic acid, hydroxy acid or a combination thereof.

* * * * *